United States Patent [19]

Ito et al.

[11] 4,256,935

[45] Mar. 17, 1981

[54] COAXIAL CABLE CONNECTOR RECEPTACLE

[75] Inventors: Katsuo Ito; Bunjiro Murata, both of Kanazawa; Kazunori Yoshimura, Nonoichi; Kenichi Yamaguchi, Kanazawa, all of Japan

[73] Assignee: Murata Manufacturing Co., Ltd., Japan

[21] Appl. No.: 66,579

[22] Filed: Aug. 15, 1979

[30] Foreign Application Priority Data

Aug. 22, 1978 [JP] Japan ..... 53-115569[U]
Aug. 22, 1978 [JP] Japan ..... 53-115570[U]

[51] Int. Cl.[3] ..... H01R 13/70

[52] U.S. Cl. ..... 200/51 R; 307/112; 339/177 R; 358/188

[58] Field of Search ..... 307/112; 358/188; 343/702; 339/177 R, 177 E; 200/51 R

[56] References Cited

U.S. PATENT DOCUMENTS

| | | | |
|---|---|---|---|
| 1,058,032 | 4/1913 | Campbell | 339/177 E |
| 2,805,399 | 9/1957 | Leeper | 339/177 R |
| 3,525,973 | 8/1970 | Kipnes | 339/177 R |
| 3,757,272 | 9/1973 | Laramee et al. | 339/177 R |
| 3,987,448 | 10/1976 | Scheppman | 343/702 |
| 4,097,899 | 6/1978 | Yu | 358/188 |
| 4,193,076 | 3/1980 | Ito et al. | 343/702 |

FOREIGN PATENT DOCUMENTS 1766367 7/1971 Fed. Rep. of Germany ..... 307/112

*Primary Examiner*—John W. Shepperd
*Attorney, Agent, or Firm*—Ostrolenk, Faber, Gerb & Soffen

[57] ABSTRACT

A coaxial cable connector receptacle comprises a cylindrical shield casing made of a metallic plate and having openings at both ends, and an inner casing made of an insulating material and housed inside the shield casing and having apertures at both ends corresponding to the openings of the shield casing. The inner casing is formed of a protruding portion at the side surface thereof, the protruding portion being formed of a groove communicating with the inside of the inner casing and receiving a contact of an external circuit. A contact member having a first and second contact is provided inside the inner casing and the first contact is positioned for receiving a center conductor of a coaxial cable at the position opposing one aperture of the inner casing, while the second contact is formed at the position opposing the groove of the protruding portion in the direction orthogonal to the longitudinal direction for receiving a contact of the external circuit. The center conductor of the coaxial cable is placed in contact with the first contact of the contact member through the opening of the shield casing and the aperture of the inner casing, while the contact from the external circuit is placed in contact with the second contact of the contact member through the groove of the protruding portion.

32 Claims, 11 Drawing Figures

COAXIAL CABLE CONNECTOR RECEPTACLE

BACKGROUND OF THE INVENTION

1. Field of the Invention

The present invention relates to a coaxial cable connector receptacle. More specifically, the present invention relates to a coaxial cable connector receptacle that can be advantageously utilized as an antenna terminal of a television receiver, for example.

2. Description of the Prior Art

As well known, typically a television receiver utilizes an antenna terminal board for feeding a received signal from an antenna to a television receiver circuit. Typically, a coaxial cable of 75Ω and/or a feeder line of 300Ω are used as a line for connection between an antenna and an antenna terminal board.

The present invention is directed to a coaxial cable connector receptacle that can be advantageously employed in an antenna terminal board of a television receiver, for example. It is desired that such an antenna terminal board is structured such that an antenna feed line can be connected to a television receiver on a foolproof basis irrespective of whether an antenna line is a coaxial cable of 75Ω or a feeder line of 300Ω even if a connection is made by a layman. However, an existing antenna terminal board is complicated in structure and is liable to cause an erroneous connection, as compared with the present invention.

SUMMARY OF THE INVENTION

Briefly, the present invention comprises a coaxial cable connector receptacle including a shield casing, an inner casing, and a contact member. The shield casing is made of an electrically conductive material and is formed in a cylindrical shape having openings at both ends and a first aperture formed at the side thereof. The inner casing is made of an insulating material and shaped to be housed inside the shield casing and has a second aperture at one end corresponding to one opening of the shield casing and a third aperture at the side thereof corresponding to the first aperture of the shield casing. The contact member is made of an electrically conductive material so as to be housed in the inner casing and comprises a first contact for directly or indirectly connection to a center conductor of a coaxial cable and a second contact formed at the position corresponding to the third aperture of the inner casing for connection to a contact from an external circuit guided through the first aperture of the shield casing and the third aperture of the inner casing. An outer conductor of the coaxial cable is directly or indirectly connected to the shield casing.

According to the present invention, a contact from a coaxial cable or any other external circuit can be selectively connected. Accordingly, such a connector receptacle for use with a coaxial cable can be advantageously utilized as an antenna terminal board and in any other equipment.

According to a preferred embodiment of the present invention, a novel structure for switching a connection to a coaxial cable or to a contact of any other external circuit is provided. Such a structure comprises a switch body having a knob made of synthetic resin, a base board made of synthetic resin for slidably supporting the switch body, guide means provided at one side of the switch body and operatively coupled to the base board for preventing the switch body from being raised and for guiding a sliding movement of the switch body in the longitudinal direction thereof, and means provided at the other side of the switch body for suppressing the switch body at one side thereof and for determining a slide switch position. According to a preferred embodiment of the present invention, such a scheme for switchable connection can be implemented with a less expensive cost and accordingly an antenna terminal board, for example, employing such scheme can also be implemented with a less expensive cost.

Therefore, a principal object of the present invention is to provide a connector receptacle for use with a coaxial cable of a novel structure for a selective connection to a coaxial cable and a contact from other external circuit.

Another object of the present invention is to provide a coaxial cable connector receptacle of a simple structure.

A further object of the present invention is to provide a coaxial cable connector receptacle of a novel switching structure.

Still a further object of the present invention is to provide a coaxial cable connector receptacle which can be advantageously utilized as an antenna terminal board, for example.

These objects and other objects, features, aspects and advantages of the present invention will become more apparent from the following detailed description when taken in conjunction with the accompanying drawings.

BRIEF DESCRIPTION OF THE DRAWINGS

FIGS. 4A to 4C show a switch mounting structure, wherein FIG. 4A is a plan view, FIG. 4B is similar to FIG. 4A but in a different state, and FIG. 4C is a sectional view taken along the line IVC—IVC shown in FIG. 4A;

FIGS. 6A and 6B show another embodiment of a switch mounting structure, wherein FIG. 6A is a plan view and FIG. 6B is a sectional view taken along the line VIB—VIB shown in FIG. 6A.

DESCRIPTION OF THE PREFERRED EMBODIMENTS

In the following the present invention will be described in the form of an embodiment as embodied as a coaxial cable connector receptacle for use in an antenna terminal board of a television receiver. However, it should be pointed out that the same is not to be taken by way of limitation, inasmuch as the present invention can be equally applicable to a coaxial cable connector receptacle for simultaneous or selective connection to a coaxial cable and an external contact other than the coaxial cable.

Figure 1:
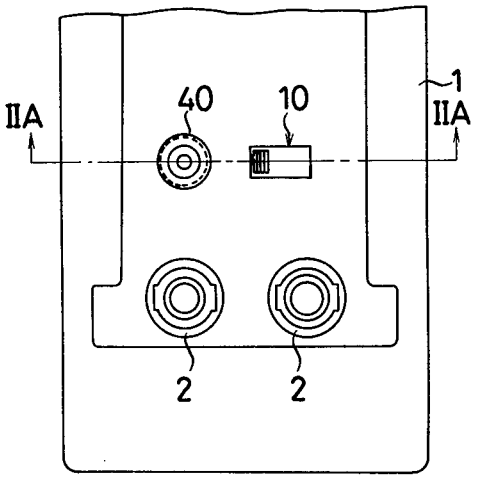
FIG. 1 is a plan view showing a major portion of an antenna terminal board of a preferred embodiment of the present invention.

FIG. 1 is a plan view showing a major portion of an antenna terminal board of a preferred embodiment of the present invention. An antenna terminal board comprises a terminal plate 1 made of synthetic resin, for example, feeder terminals 2, 2 provided to the terminal plate 1 for connection to a feeder line to be described subsequently, a connector receptacle 40 for connection to a coaxial cable, and a switch 10 for selectively connecting a feeder line of 300Ω to the connector receptacle 401.

Figure 2A:
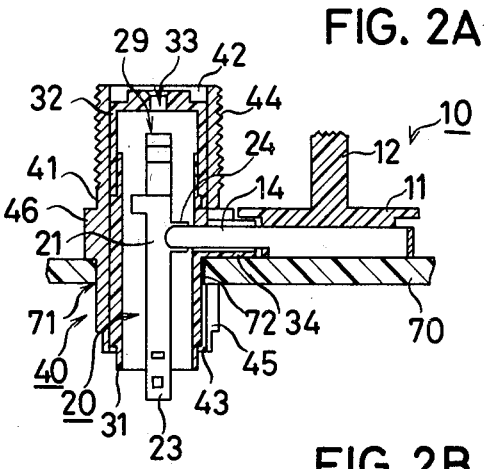
FIG. 2A is a sectional view of the FIG. 1 embodiment taken along the line IIA—IIA shown in FIG. 1.

FIG. 2A is a sectional view taken long the line IIA—IIA shown in FIG. 1. As seen from FIG. 2A, the switch 10 is slidably provided to a base plate 70 underlying the terminal plate 1, (not shown in FIG. 2A). The base plate 70 is formed of an aperture 71 for insertion of a shield case 41 constituting the connector receptacle 40. The shield case 41 is made of a metallic material and is formed of a male screw 44 at the upper side surface for screwing of a coaxial cable connector plug, not shown, thereon. The shield case 41 is formed of openings 42 and 43 at an upper and lower ends. The shield case 41 is further formed of a stopper 46 at the intermediate position so as to protrude in the radial direction in the form of a thick portion. On the other hand, the base plate 70 is correspondingly formed of a protrusion 72 at a portion of the inner periphery of the aperture 71 so as to protrude inward from the inner periphery of the aperture 71. The shield case 41 is inserted from upward into the aperture 71 of the base plate 70 until the same is stopped by the stopper 46. The shield casing 41 is formed of a slit 45 extending at the lower portion thereof from the opening 43 in the longitudinal direction thereof, such that the protrusion 72 fits into the slit 45 when the shield case 41 is inserted into the aperture 71 of the base plate 70. The slit 45 and the protrusion 72 cooperatively function to prevent rotation of the shield case 41. The shield casing 41 inserted into the aperture 71 of the base plate 70 is fixed by means of a nut, not shown, at the lower side of the base plate 70, thereby to prevent upward slippage thereof.

An inner casing 30 made of an insulating material such as synthetic resin (shown by two dotted lines in FIG. 3) is housed inside the shield casing 41. The inner casing 30 comprises a lower casing 31 having an upper end opening, and an upper casing 32 having a lower end opening being fitted to the upper end opening of the lower casing 31. As better seen from FIG. 3, the lower casing 31 is formed of an outwardly protruding contact guide 34 at a portion of the side peripheral surface thereof. The contact guide 34 is formed in a U letter shape in section, whereby a guide groove **34*a* is formed. The guide groove 34*a* is communicated with the inside of the lower casing 31, thereby to perform a guiding and retaining function of a switch contact 14 to be described subsequently. The upper casing 32 is formed of an aperture 33 at the upper end thereof corresponding to the opening 42 of the shield casing 41** and for receiving a center conductor of a coaxial cable to be described subsequently.

It is pointed out that originally the contact guide 34 merely cooperate with a slit extending from the opening 43 of the shield casing 41 (which may be the same as the above described slit 45) to serve as an example of a rotation preventing means for preventing relative rotation between the shield casing 41 and the inner casing 30. Accordingly, if and when such a rotation preventing means is separately provided, such protruded contact guide 34 can be dispensed with and accordingly the guide groove 34 can be dispensed with. More specifically, in order to receive the switch contact 14 from an external circuit, it is sufficient to merely form an aperture at a corresponding position of the inner casing 30.

By way of an alternative example of such a rotation preventing means, the following schemes may be employed. A notch portion may be formed at the end edge of the lower opening 43 of the shield casing 41 and a protrusion for engagement with the notch portion may be formed at a corresponding portion of the lower casing 31 of the inner casing 30. Alternatively, the side surface of the lower end opening of the lower casing 31 may be configured to include at least two flat portions rather than a circle of the embodiment shown, whereupon the end edge of the lower opening 43 of the shield casing 41 is deformed toward the above described at least two flat portions to be in contact with the flat portions, so that the lower casing 31 may be supported in a pressure contact manner at the end portion of the opening 43.

A clip 20 constituting another feature of the present invention is housed inside the inner casing 30. The structure of the clip 20 will be described with reference to FIG. 3. The clip 20 is made of a metallic or electrically conductive material. The clip 20 is formed by jointing two plates of substantially the same configuration at a lower portion thereof. The two plates each have an elongated conductor portion 21, which is formed of a cut and raised tongue piece 22 and a terminal 23 at the lower portion thereof. The raised tongue piece 22 functions to abut against the inner side wall of the inner casing 30, thereby to fixedly support the clip 20 when the clip 20 is inserted into the inner casing 30 and thus the lower casing 31. The terminal 23 is formed of an aperture for facility of soldering the lead wire of other components, not shown. The conductor portion 21 is formed of receiving pieces 24 at one side end so as to be protruded and to be flared outward at the chip end thereof. These two receiving pieces 24 cooperatively constitute a contact 25 to be in contact with a switch contact 14 to be described subsequently. The conductor portion 21 is further formed of a protrusion 26 at the position above the contact 25 at the side end opposite to that of the contact 25. The protrusion 26 is formed to prevent play occurring when the clip 20 is inserted in the inner casing 30. Accordingly, the chip end of the protrusion 26 is adapted to be in contact with the inner side wall of the inner casing 30 and thus the lower casing 31. The conductor portion 21 is further formed of a curved spring portion 27 curved at an obtuse angle in the longitudinal direction, the upper end of which is flared outward to form receiving pieces 28. One of the receiving pieces 28 is formed of side pieces **28*a*. Thus, a contact 29 of a funnel-shape is formed by the above described receiving pieces 28 and the side pieces 28*a*. The above described funnel-shaped contact 29 is adapted to receive and be connected to a center conductor 51 of a coaxial cable 50 being inserted in the arrow A direction from the aperture 33 of the above described upper casing 32. The side surface of the curved spring portion 27 is selected to be so large as to be pressure contacted to a portion inward by the inner side wall of the inner casing 30 and thus the lower casing 31, so that the center conductor 51 being connected to the above described contact 29 is retained in a pressure contact manner. It is a matter of course that the contact 25 is faced to the groove 34*a* of the contact guide 34 provided at the lower casing 31 while the contact 29 is faced to the aperture 33 provided at the upper casing 32**.

Figure 3:
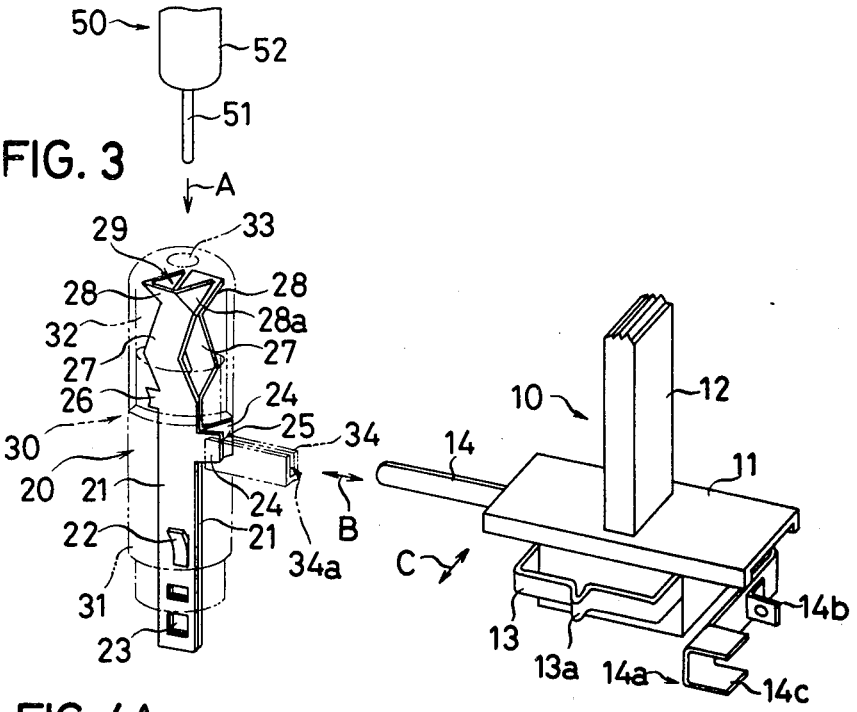
FIG. 3 is a perspective view showing an essential portion of the present invention.

Although in the FIG. 3 embodiment the contact member i.e. the first contact 29 and the second contact 25 of the clip 20 were structured to be of two faced contact pieces, alternatively these contacts each may be structured in a single contact piece, in which case some processing such as bending may be applied to enable a stable contact of a center conductor of a coaxial cable and a switch contact 14 from an external circuit.

Now the structure of the switch 10 will be described, again referring to FIG. 3. The switch 10 comprises a main body 11 made of synthetic resin, for example. The main body 11 is formed of an upright knob 12 at the center of the upper surface thereof. The main body 11 is fitted at the lower surface thereof in a groove, not shown, of the base plate 70, so that the main body 11 is slidable in the arrow B direction in FIG. 3 and in the left and right direction in FIG. 2A. The main body 11 is further formed at one side surface a spring portion 13 integrally protruded from the main body 11. The spring portion 13 is formed of a protrusion 13*a* at the center thereof. Accordingly, it follows that the protrusion 13*a* is afforded elasticity in the arrow C direction in FIG. 3. The main body 11 is provided with a leaf contact 14 extending in the sliding direction of the switch, so that the contact 14 may be slidable integrally with the main body 11. The chip end of the contact 14 is shaped in a semicircular shape, while the other end of the contact 14 is bent to constitute a terminal 14*a*, which is used to fix a lead wire of a balanced-unbalanced or balun transformer to be described subsequently. Meanwhile, if and when the contact 24 of the clip 20 is formed in a single contact piece, then one end of the contact 14 is preferably structured to be of two faced contact pieces so as to receive the contact 24 of the single contact piece in a sandwitched manner. However, even in such a case, the contact 14 also may be formed in a single contact piece. Alternatively, the contact 14 may be formed pin like rather than a leaf contact piece.

Figure 4A:
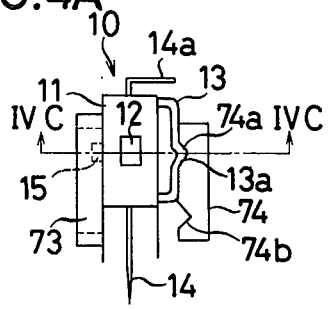
Figure 4B:
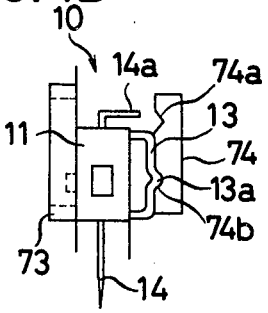
Figure 4C:
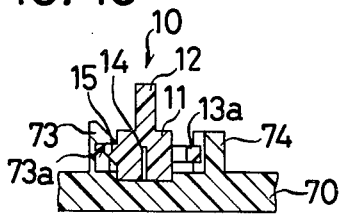

A structure for mounting the switch 10 to the base plate 70 is depicted in more detail in FIGS. 4A, 4B and 4C.

Figure 2B:
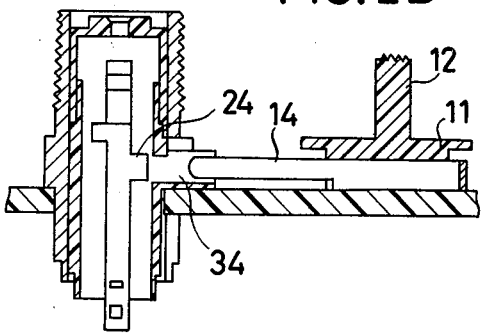
FIG. 2B is similar to FIG. 2A but shows a sectional view in a different state.

FIG. 4A is a plan view showing a structure for mounting the switch 10 to the base plate 70 and FIG. 4B is a plan view of the same but in a different state. FIG. 4C is a sectional view taken along the line IVC—IVC shown in FIG. 4A. FIGS. 4A and 4B show the structure in two different switched state. As seen from FIG. 4C, the lower portion of the main body 11 of the switch 10 is fitted in the groove of the base plate 70. Thus, the groove serves as a means for guiding of a sliding movement of the switch main body 11. The main body 11 is formed of a protruded engaging portion 15 at the side surface opposite to that of the spring portion 13 and thus the protrusion 13*a*. The engaging portion 15 has a flat upper surface. On the other hand, the base plate 70 is formed of an engaging portion 73 and a positioning portion 74 so as to sandwitch the switch main body 11 fitted in the groove. The lower surface 73*a* of the engaging portion 73 is in contact with the upper surface of the above described engaging portion 15. Accordingly, the switch main body 11 is, at one side thereof, prevented from being removed by means of the engaging portions 15 and 73 and is guided to a sliding movement thereof. Alternatively of prevention of the switch main body 11 from being removed by means of the engaging portions 15 and 73, the switch main body 11 may be pressed by means of the antenna terminal board 1 shown in FIG. 1 for the same purpose. A combination of such two approaches makes it possible to more safely retain the switch main body 11. The engaging portions 15 and 73 further function to tentatively fix the switch main body 11 to the base plate 70 until these are mounted to the antenna terminal board 1 shown in FIG. 1 is mounted. As clearly seen from FIG. 4A, the positioning portion 74 has two recesses or notches 74*a* and 74*b*. Both the notches 74*a* and 74*b* are selected to be sufficiently large enough to receive the protrusion 13*a* carried by the spring portion 13 and to fixedly retain the protrusion 13*a* is received therein. As clearly seen from FIGS. 4A and 4B, the spring portion 13 and thus the protrusion 13*a* and the positioning portion 74 and thus the notches 74*a* and 74*b* cooperate to position the switch main body 11 at two different positions. Since the protrusion 13*a* is elastically carried by the spring portion 13, a switching displacement of the switch main body 11 between the notches 74*a* and 74*b* can be readily achieved, merely with a slightly increased resistance on the occasion of a shift of the protrusion 13*a* from one notch to other. Meanwhile, in the embodiment shown, the contact 14 is separated apart from the contact 25 of the clip 20 in the state shown in FIG. 4A and is rendered in contact with the contact 25 in the state shown in FIG. 4B. More specifically, the state shown in FIG. 4B corresponds to the state shown in FIG. 2A and the state shown in FIG. 4A corresponds to the state shown in FIG. 2B. Thus, the switch contact 14 can be selectively rendered in contact with the contact 25 of the clip 20. As seen from FIG. 2B, when the switch 10 is placed in the state shown in FIG. 4A, i.e. when the contact 14 is separated from the contact 25, the contact 14 is placed in a state wherein the contact 14 is retained in the groove 34*a* of te contact guide 34 formed in the lower casing 31.

If and when the contact guide 34 is not provided in the inner casing 30 and merely an aperture is formed, as described previously, then protrusions may be formed spaced apart slightly more broadly than the switch contact 14 on the base plate 70 in order to guide the switch contact 14 in the direction of the contact 24 of the clip 20, i.e. in the direction of the aperture formed in the shield casing 41 and the inner casing 30, so that the contact 14 may be guided. Such a guide for the contact 14 can be dispensed with, however.

Figure 5:
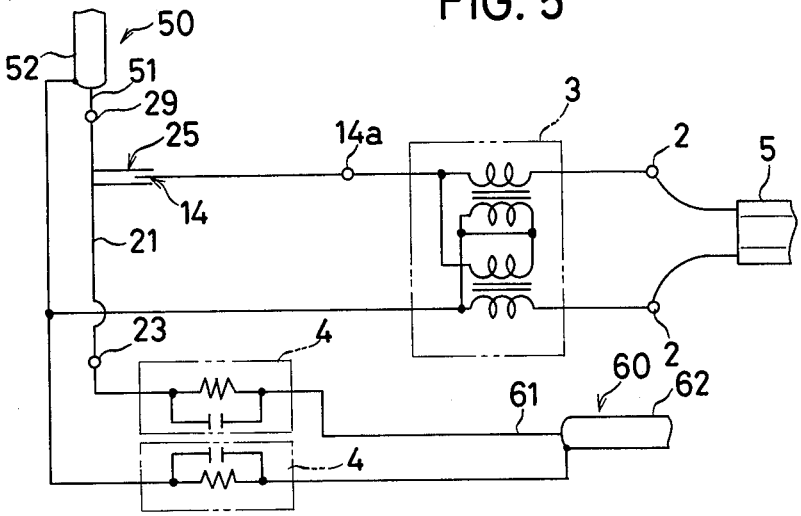
FIG. 5 is a schematic diagram of an antenna terminal board of a preferred embodiment of the present invention.

FIG. 5 is a schematic diagram of a preferred embodiment of the present invention. The coaxial cable 50 comprises an outer conductor 52 and a center conductor 51 and the center conductor 51 is inserted through the opening 42 of the shield casing 41 and the aperture 33 of the upper casing 32 to one contact 29 of the clip 20 and is connected thereto. The conductor portion 21 and thus the terminal 23 of the clip 20 is connected to one input of one of a well known RC composite component 4. At the same time, the outer conductor 52 of the coaxial cable 50 is connected to the other input of the other RC composite component 4. More specifically, the outer conductor 52 of the coaxial cable 50 is electrically connected to the outer surface of the shield casing 41 shown FIGS. 2A and 2B and is mechanically fixed by means of a cap, not shown. The output of the one RC composite component 4 is connected to the center conductor 61 of the coaxial cable 60 so that the same is applied to a tuner input of a television receiver, while the output of the other RC composite component 4 is connected to the outer conductor 62. Thus, in connecting a coaxial cable of 75Ω to the antenna terminal plate and thus the connector receptacle 40, the switch 10 is turned to the state shown in FIG. 2B and thus shown in FIG. 4A. Then, the contact 14 is separated from the contact 25, so that the contact 14 is not influenced by the input through the feeder terminal 2.

In connecting a feeder line of 300Ω to the antenna terminal board the switch 10 is brought to the state shown in FIG. 2A and thus shown in FIG. 4B. Then the contact 14 is brought in contact with the contact 25. At that time, the coaxial cable 50 is not connected. The parallel lines of the feeder line 5 are connected to the feeder terminals 2, respectively. One feeder terminal 2 is connected to one input of a well known impedance converting balun transformer 3 and the other feeder terminal is connected to the other input of the balun transformer 3. One output of the balun transformer 3 is connected to the terminal 14*a* of the contact 14 provided in the switch 10 and the other output of the balun transformer 3 is connected to the other input of the above described other RC composite component 4. Since at that time the contact 14 is placed in a state being connected to the contact 25, it follows that the coaxial cable 60 is supplied with a signal from the feeder line 5.

In connecting one output of the balun transformer to the terminal 14*a* of the switch contact 14, the corresponding lead wire is connected to a solder connecting portion 14*b* by soldering and the root portion of the lead wire is fixed by caulking a nail 14*c*. Then, the lead wire, not shown, is firmly fixed by the nail 14*c*, thereby to eliminate a possibility of disconnection, poor contact and the like of the lead wire at the soldering portion 14*b*.

Figure 6A:
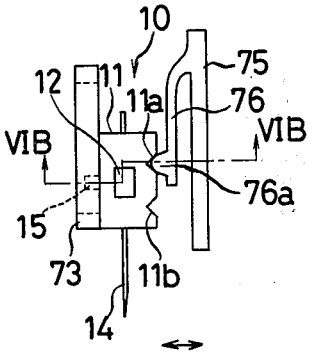
Figure 6B:
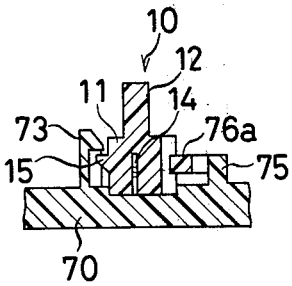

FIGS. 6A and 6B show another embodiment of a scheme for mounting the switch 10. The embodiment shown is different from that shown in FIGS. 4A to 4C in that the switch main body 11 is formed of two notches 11*a* and 11*b*. The base plate 70 is formed of a supporting portion 75 at the side of these notches 11*a* and 11*b*, so that one end of the spring portion 76 may be supported by the supporting portion 75. The chip end of the spring portion 76 is formed as a protrusion 76*a*. Accordingly, the protrusion 76*a* is retained with elasticity in the arrow direction shown in FIG. 6A as a function of the spring portion 76. The switching operation of the switch 10 is, as in case of FIGS. 4A and 4B, achieved by engagement of the protrusion 76*a* with the notch 11*a* at one state or an engagement of the protrusion 76*a* with the notch 11*b* at the other state. Thus, switching and positioning of the switch 10 is performed.

Figure 7:
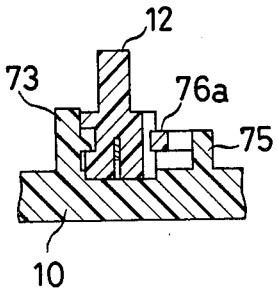
FIG. 7 is a sectional view showing a further embodiment of a switch mounting structure.

Although in the above described embodiments the engaging portion 15 being formed in the switch main body 11 was formed as protruded, alternatively the same may be implemented such that as shown in FIG. 7 parallel grooves are formed in the switch main body 11 in the longitudinal direction and the chip end of the engaging portion 73 may be engaged therewith or may be fitted therein.

Although in the above described embodiments the connector receptacle and the switch main body were mounted commonly on the base plate 70 which is different from the antenna terminal board 1, the same may be modified such that one of the connector receptacle 40 and the switch 10 is mounted to the antenna terminal plate 1 and the other is mounted to the base plate 70. Alternatively, both may be mounted to the antenna terminal board 1, while the base plate 70 may be dispensed with. In such a case some expedient for preventing the switch main body 11 from being raised might be required depending on the case.

Although in the above described embodiments the screw 44 was formed on the shield case 41, the screw 44 is not necessarily required. More specifically, when a coaxial cable connector plug of a simple insertion type is employed, the screw 44 can be dispensed with.

Although the present invention has been described and illustrated in detail, it is to be clearly understood that the same is by way of illustration and example only and is not to be taken by way of limitation, the spirit and scope of this invention being limited only by the terms of the appended claims.

What is claimed is:

1. A coaxial cable connector receptacle for connection to a coaxial cable including a center conductor and an outer conductor and for connection to a contact of an external circuit other than said coaxial cable, comprising:

a cylindrical shield casing made of an electrically conductive material and having openings at both ends and having a first aperture formed at the side surface thereof;

an inner casing made of an insulating material being housed inside said shield casing, said inner casing having a second aperture formed therein corresponding to one of said openings of said shield casing and a third aperture formed therein at the side surface thereof and corresponding to said first aperture of said shield casing; and a contact member made of an electrically conductive material and being housed in said inner casing, said contact member comprising a first contact formed at a position corresponding to said second aperture of said inner casing for direct or indirect connection to said center conductor of said coaxial cable, and a second contact formed at the position corresponding to said third aperture of said inner casing for connection to a contact extending from said external circuit through said first aperture of said shield casing and said third aperture of said inner casing;

said outer conductor of said coaxial cable being electrically connected directly or indirectly to said shield casing.

2. A coaxial cable connector receptacle in accordance with claim 1, wherein said inner casing comprises a first portion and a second portion being mated in the longitudinal direction, with said contact member housed therein, thereby to form said inner casing.

3. A coaxial cable connector receptacle in accordance with claim 1, wherein said first contact of said contact member comprises first two contact pieces as layered, said center conductor of said coaxial cable being inserted between and in contact with said first two contact pieces as layered.

4. A coaxial cable connector receptacle in accordance with claim 1, which further comprises rotation preventing means operatively coupled to said inner casing and said shield casing for preventing relative rotation between said inner casing and said shield casing.

5. A coaxial cable connector receptacle in accordance with claim 4, wherein said rotation preventing means comprises a notched portion formed at the end portion of one of said openings of said shield casing; and a protrusion formed at the corresponding end portion of said inner casing and fitted into said notched portion of said shield casing.

6. A coaxial cable connector receptacle in accordance with claim 4, wherein said rotation preventing means comprises at least two flat portions formed at one end side surface of said inner casing, and fixed portion formed at the corresponding end portion of said shield casing for pressing from outward said at least two flat portions.

7. A coaxial cable connector receptacle in accordance with claim 4, wherein said rotation preventing means comprises a protrusion formed to be protruded outward from the side surface of said inner casing, and a slit formed at the side surface of said shield casing extending from the end of said other opening for receiving said protrusion of said inner casing.

8. A coaxial cable connector receptacle in accordance with claim 7, wherein said protrusion of said inner casing is formed of a groove being communicated with the inside of said inner casing, and said contact from said external circuit is guided along said groove formed on said protrusion to be connectable to said second contact of said contact member housed in said inner casing.

9. A coaxial cable connector receptacle in accordance with claim 1, wherein said contact from said external circuit is provided in a switch switchable to a first and second positions, and said contact from said external circuit is connected to said second contact of said contact member at said first position of said switch and is disconnected from said second contact at said second position of said switch.

10. A coaxial cable connector receptacle in accordance with claim 9, wherein said second contact of said contact member comprises second two contact pieces as layered, and said contact from said external circuit is placed between and in contact with said second two contact pieces as layered.

11. A coaxial cable connector receptacle in accordance with claim 10, wherein said contact from said external circuit comprises a pin for insertion between said second two contact pieces.

12. A coaxial cable connector receptacle in accordance with claim 10, wherein said contact from said external circuit comprises a single metallic plate being inserted between said second two contact pieces as layered.

13. A coaxial cable connector receptacle in accordance with claim 9, wherein said second contact of said contact member comprises a second single contact piece, and said contact from said external circuit is adapted to be in contact with at least one of both side surfaces of said second single contact piece.

14. A coaxial cable connector receptacle in accordance with with claim 13, wherein said contact from said external circuit comprises two contact pieces as layered and said second contact of said contact member is placed in contact with between said two contact pieces as layered.

15. A coaxial cable connector receptacle in accordance with claim 13, wherein said contact from said external circuit comprises a pin for contact with one side surface of said second single contact piece of said second contact.

16. A coaxial cable connector receptacle in accordance with claim 13, wherein said contact from said external circuit comprises a single contact piece for surface contact with one side surface of said second single contact piece of said second contact.

17. A coaxial cable connector receptacle in accordance with claim 9, which further comprises guide means provided at at least one of said shield casing and said inner casing for guiding said contact from said external circuit to said second contact portion of said contact member in accordance with a switching operation from said second position to said first position of said switch.

18. A coaxial cable connector receptacle in accordance with claim 9, wherein said switch comprises a switch main body for retaining said contact from said external circuit, a base plate for slidably positioning said switch main body, slide guiding means formed on said base plate for guiding said sliding of said switch main body;

raise preventing means for preventing said switch main body from being raised from said base plate, and positioning means operatively coupled to said switch main body for stopping said sliding of said switch main body.

19. A coaxial cable connector receptacle in accordance with claim 18, wherein said shield casing is mounted to said base plate such that said first aperture is directed in the sliding direction of said switch main body.

20. A coaxial cable connector receptacle in accordance with claim 18, wherein said shield casing is mounted to a further base plate different from said base plate such that said first aperture is directed in a sliding direction of said switch main body.

21. A coaxial cable connector receptacle in accordance with claim 18, wherein said raise preventing means comprises a first engaging portion formed on one side surface of said switch main body extending from said base plate, and a second engaging portion formed on said one side surface of said switch main body for engagement with said first engaging portion.

22. A coaxial cable connector receptacle in accordance with claim 21, wherein said first engaging portion extends from said base plate in the vertical direction and comprises at the chip end thereof a protrusion protruding at said one side surface of said switch main body, and said second engaging portion is formed to be protruded from said one side surface of said switch main body for engagement with said protrusion of said first engaging portion.

23. A coaxial cable connector receptacle in accordance with claim 21, wherein said positioning means comprises a protrusion formed at the other side surface of said switch main body, and a recess formed on said base plate for receiving said protrusion corresponding to said sliding stop position.

24. A coaxial cable connector receptacle in accordance with claim 23, wherein said protrusion formed at said other surface of said switch main body is retained with elasticity urging said protrusion in the lateral direction of said switch main body.

25. A coaxial cable connector receptacle in accordance with claim 21, wherein said positioning means comprises a protrusion formed on said base plate protruding to be opposed to the other side surface of said switch main body, and a recess formed at said other side surface of said switch main body for receiving said protrusion corresponding to said slide stop position.

26. A coaxial cable connector receptacle in accordance with claim 25, wherein said protrusion formed on said base plate is retained with elasticity urging said protrusion onto said other side surface of said switch main body.

27. A coaxial cable connector receptacle in accordance with claim 18, wherein said slide guiding means comprises a groove formed on said base plate and having the width slightly larger than the width of said switch main body.

28. A coaxial cable connector receptacle in accordance with claim 18, wherein said base plate comprises a guide portion for guiding said contact from said external circuit retained by said switch main body in the direction of said first aperture of said shield casing.

29. A coaxial cable connector receptacle for connection to a coaxial cable and for connection to a contact extending from an external circuit other than said coaxial cable, comprising:

a cylindrical shield casing having openings at opposite longitudinal ends thereof;

an inner casing made of an insulating material and being housed inside said shield casing and having apertures at both ends corresponding to said openings of said shield casing;

a protruding portion formed to be protruded outward at the side surface of said inner casing and having a groove for communication with the inside of said inner casing;

said shield casing having a slit formed therein for receiving said protruding portion; and a clip made of an electrically conductive material comprising a first connection portion being provided inside said inner casing and formed at a position opposing one of said apertures of said inner casing for connection to a center conductor of a coaxial cable, and a second connection portion formed at the position opposing said groove of said protruding portion in a direction orthogonal to the longitudinal direction of said shield casing for connecton to said contact from said external circuit.

30. A coaxial cable connector receptacle in accordance with claim 29, wherein said slit formed in said shield casing is formed extending from the end of one of said openings at the side surface of said shield casing, and said protruding portion of said inner casing is fitted in said slit from the end of one of said openings.

31. A coaxial cable connector receptacle in accordance with claim 29, wherein said protruding portion is substantially U letter shaped in section.

32. A coaxial cable connector receptacle in accordance with claim 29, wherein said contact from said external circuit extends from a switch sliding in said orthogonal direction and the chip end thereof is connected to said second connection portion at a first position of said switch and is disconnected from said second connection portion at a second position of said switch to be retained in said groove of said protruding portion.

* * * * *